US005619948A

United States Patent [19]

Keyvani

[11] Patent Number: 5,619,948

[45] Date of Patent: Apr. 15, 1997

[54] POWERED SWIMMING AID

[76] Inventor: Daryoush Keyvani, 321 S. San Vicente Blvd., Apartment No. # 601, Los Angeles, Calif. 90048

[21] Appl. No.: 21,182

[22] Filed: Feb. 22, 1993

Related U.S. Application Data

[63] Continuation-in-part of Ser. No. 598,481, Oct. 8, 1990, Pat. No. 5,188,552.

[51] Int. Cl.[6] ..... B63C 11/46

[52] U.S. Cl. ..... 114/315; 440/49; 440/113

[58] Field of Search ..... 114/315; 440/26, 440/28–32, 49, 113

[56] References Cited

U.S. PATENT DOCUMENTS

| | | | |
|---|---|---|---|
| 1,232,241 | 7/1917 | Diamond | 114/315 |
| 1,277,022 | 8/1918 | Young | 440/31 |
| 1,299,000 | 4/1919 | Moore | 440/31 |
| 4,437,842 | 3/1984 | Connor | 441/65 |
| 5,188,552 | 2/1993 | Keyvani | 441/116 |

FOREIGN PATENT DOCUMENTS

| | | | |
|---|---|---|---|
| 0612979 | 11/1926 | France | 440/31 |
| 2415965 | 10/1975 | Germany | 440/31 |
| 3139992 | 4/1983 | Germany | 440/31 |
| 0600162 | 11/1959 | Italy | 114/315 |

*Primary Examiner*—Sherman Basinger

*Attorney, Agent, or Firm*—Gene Scott—Patent Law & Venture Group

[57] ABSTRACT

A powered swimming aid comprising a stabilizing member attached to the users back, and buoyancy device rigidly attached to the stabilizing member, the buoyancy device being located below the user's hips so as to cause the body to rotate to a good swimming position. The rigid structure also has mounted on it a drive mechanism terminating in a propeller located below the user's hips so as to cause the body to rotate to a good swimming position. The rigid structure also has mounted on it a drive mechanism terminating in a propeller located below the user's knees to provide powered motion in the motor. A buoyant board has side handles and a control for controlling the drive mechanism. A buoyant vest is worn on the user's chest.

16 Claims, 6 Drawing Sheets

POWERED SWIMMING AID

This is a continuation-in-part of application Ser. No. 07/598,481 filed Oct. 8,1990 which matured into U.S. Pat. No. 5,188,552 issued on Feb. 23,1993, the entire content of which is incorporated herein by this reference.

BACKGROUND—OF FIELD OF INVENTION

The present invention concerns a swimming aid for use by persons who swim in man made bodies of water, in rivers, lakes or the sea.

BACKGROUND—DISCUSSION OF RELATED ART

A number of flotation devices are known for use by swimmers, practically all of which are simply floats which prevent a person from sinking and possibly drowning and which have the drawback of hindering free movement of a swimming person.

SUMMARY OF THE INVENTION

The center of gravity of a human body in water is shifted to the lower portion of the body because of the specific gravity of the lungs. Existing flotation devices increase the buoyancy of the upper part of the body causing the body to be maintained in essentially a vertical position.

It is the object of the invention to provide a device which while acting as a float does permit free movement of a swimmer's arms and legs. The primary advantage of the swimming aid is to readjust the center of gravity of a body in water to the midsection of the body which makes it easier for a swimmer to maintain a horizontal position in the water.

Existing floatation devices attach to the widest part of the body and have a large surface area which dramatically increases the surface resistance to movement in water. An additional advantage of the present invention is that it provides a buoyancy equivalent to the inventions in the prior art, but with a hydrodynamically designed shape which lessens the surface resistance of the device. This allows a person wearing the swimming aid to proceed through the water with greater ease and speed compared to a swimmer wearing various existing flotation devices.

The invention is particularly useful in aiding long distance swimmers by increasing their buoyancy and maintaining their horizontal position in the water thereby reducing the amount of energy which has to be expended in order to proceed in the water to reach a distant target point. The swimming aid allows the swimmer to rest when becoming tired.

Another advantage of the device is its use as an aid in teaching persons how to swim because the support the swimming aid gives to the body and the absence of any danger of sinking helps to alleviate the beginner's anxiety. An additional advantage is that the device will be useful in hydrotherapy in supporting the patient's body in the water and making therapeutic manipulations easier.

According to the invention the new device comprises a vest fabricated from a flexible material comprising front and rear sections with an aperture the edges of which, when the swimming aid is worn, extend around the neck of the wearer. Upper and lower crosswise extending stiffening members extend outward from a downward extending rod. A float extends from the lower end of the rod said float being angularly disposed to the longitudinal axis of said rod. The back of the vest is connected to the upper section of the upper crosswise extending stiffening member by quick releasing connecting means. Straps attached to the side sections of the upper crosswise extending stiffening member extend under the armpits and are connected to straps attached on the front sides of the vest by quick releasing connecting means securing the vest the upper body. Straps attached to the side sections of the lower crosswise extending stiffening member are connected to straps attached to the front sides of the vest at waist level by quick releasing connecting means securing the vest to the midsection of the body. Straps attached to the lower section of the lower crosswise extending stiffening member pass between the legs under the crotch of the wearer and are connected to straps on the lower front section of the vest by quick releasing connecting means firmly securing the swimming aid to the body.

In one embodiment a power assembly is attached to the structure, the drive portion being located at the user's lower torso and driving a propeller which is positioned below the user's knees. The power assembly propels the user through the water and also by reason of the angle and position of the propeller, helps keep the user's head above water. A floatation board also is provided and holds a control module for the drive assembly. The device can be used for sport, recreation and transporting a person in the water.

Description of the Preferred Embodiments

Figure 1:
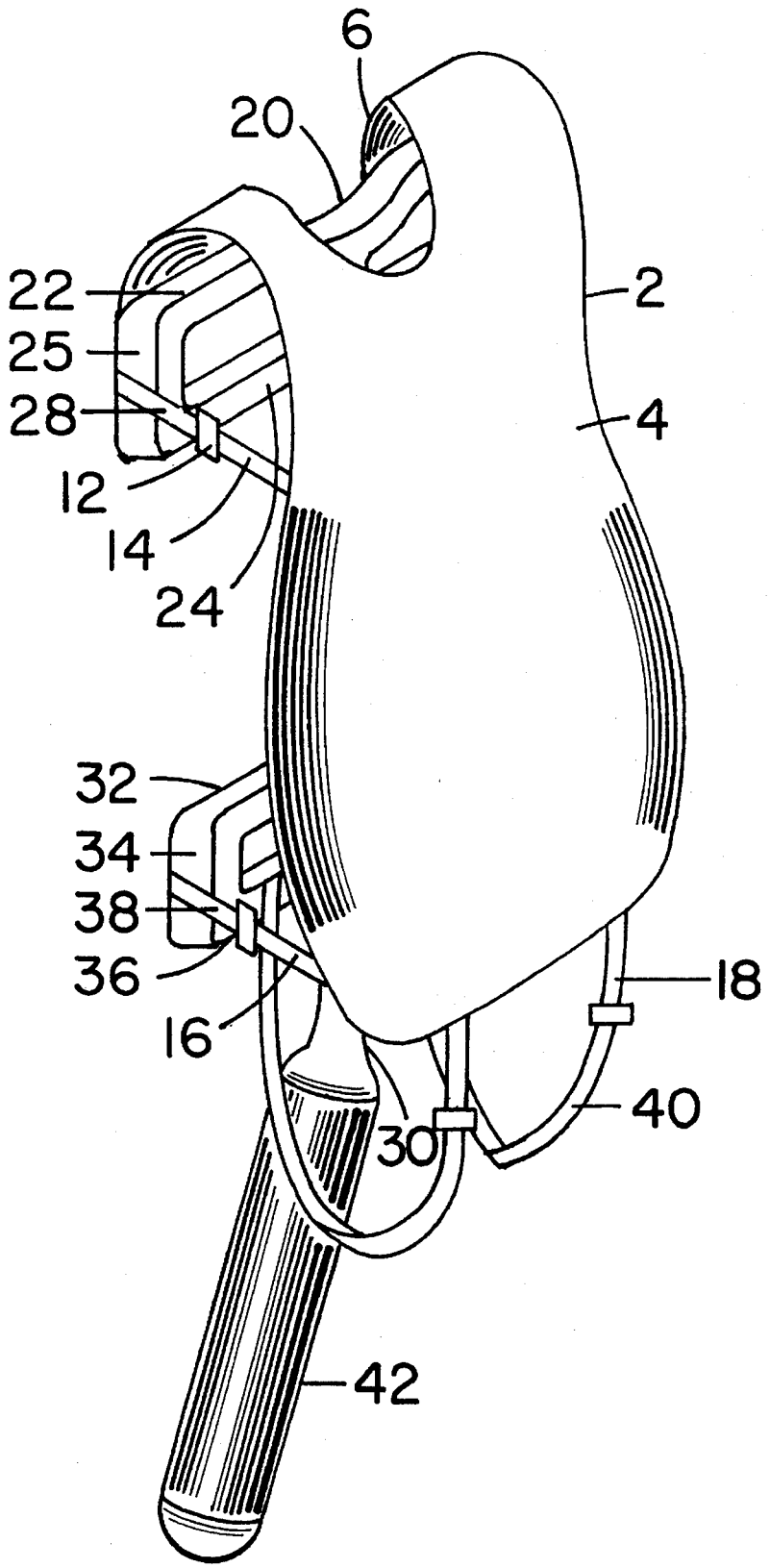
FIG. 1 is a perspective view of the swimming aid.

Referring now the drawings the primary embodiment and best mode for carrying out the invention is shown in FIG. 1 in a perspective view.

Figure 2:
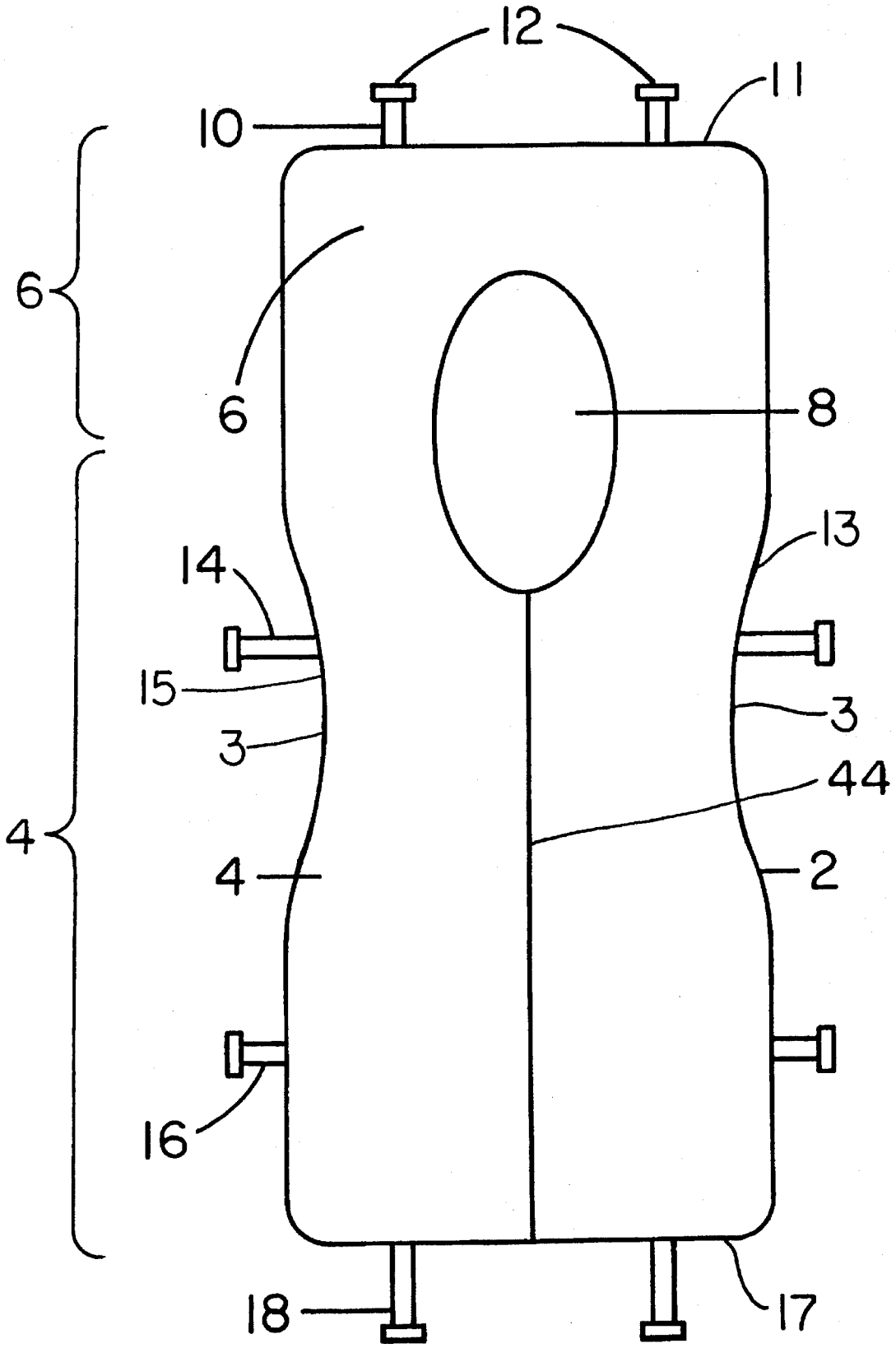
FIG. 2 is a plan view of the vest.

FIG. 2 shows a plan view of vest 2 of a generally rectangular shape cut inward in an arcuate pattern where the vest lies over the shoulders of the wearer said vest 2 being fabricated from a flexible material. The material is folded double to form longer front section 4 which extends to the waist and shorter rear section 6 which extends to just below the shoulders. An oblong section is cut from the material near the end forming aperture 8 through which the head of the wearer is inserted. Pairs of straps are sewably attached to the edges of vest 2 on front section 4 and rear section 6. Quick releasing connecting means 12 are attached to the free ends of each strap.

Vertical back straps 10 are attached to vest 2 at the lower edge 11 of rear section 6 over the right and left shoulders. Lateral upper body straps 14 are attached to the right side edge 13 and left side edge 15 of front section 4 of vest 2 just under the arm pits. Lateral waist straps 16 are attached to the right side edge 13 and left side edge 15 near the bottom of front section 4. Vertical crotch straps 18 are attached at both sides of the lower edge 17 of front section 4.

Figure 3:
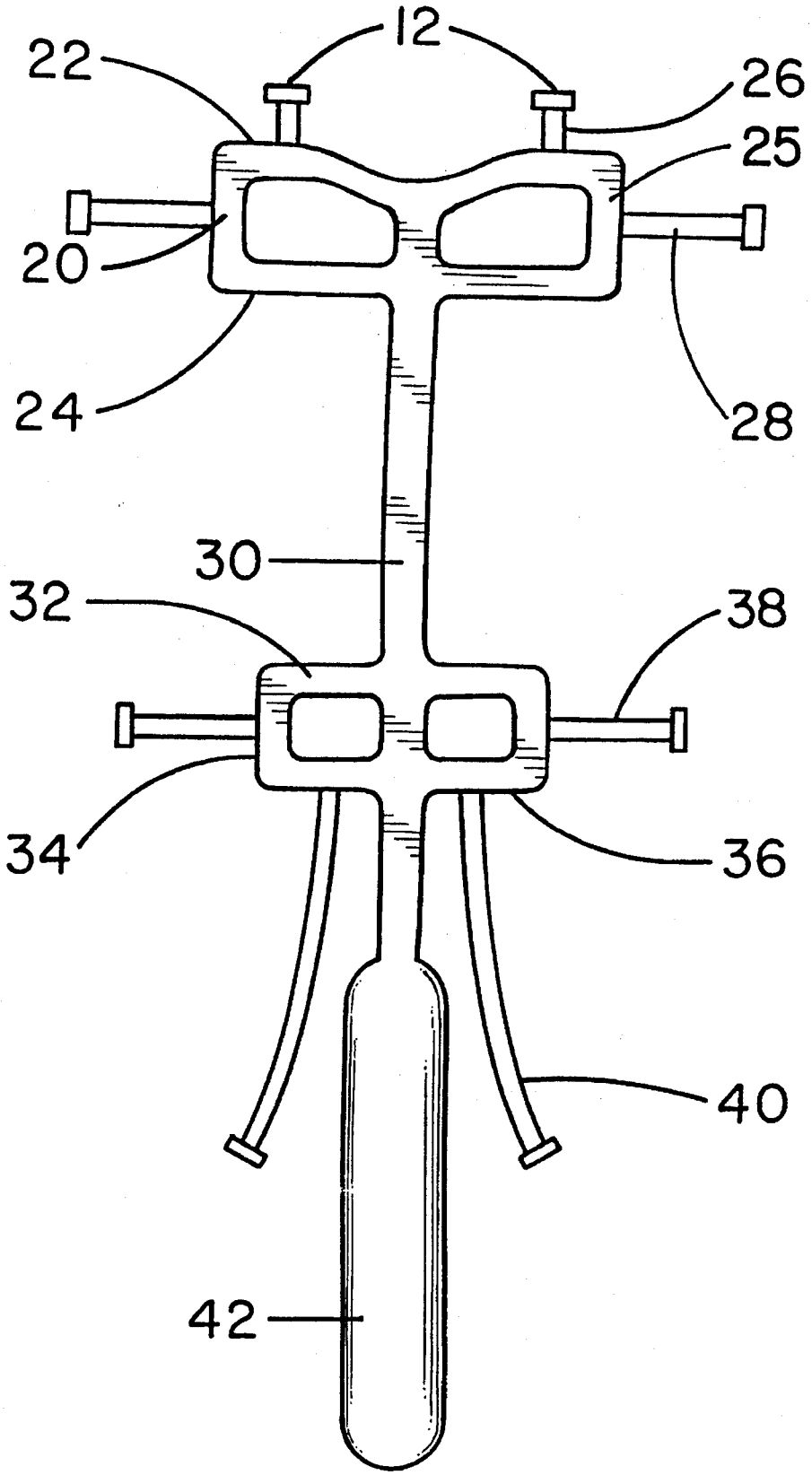
FIG. 3 is a plan view of the upper and lower crosswise extending stiffening members, the attached straps, the rod and the attached float.

FIG. 3 is a plan view showing the attachment of upper and lower crosswise extending stiffening members 20 and 32 and float 42 to rod 30. Downward extending rod 30 is attached to upper crosswise extending stiffening member 20. Lower crosswise extending stiffening member 32 is attached to rod 30. Float 42 is attached at the lowermost end of rod 30. Crosswise extending stiffening members 20 and 32, rod 30 and float 42 may be conveniently fabricated from low density metal, plastic or wood.

Upper crosswise extending stiffening member 20 has a generally rectangular shape comprising two II shaped structures attached to rod 30. The length of the longer side is the shoulder width of an average human torso; the length of the shorter side is about one third the length of the longer side. The upper horizontal section 22 of upper crosswise extending stiffening member 20 is straight for a short distance from the outer edge then curved slightly downward to the center. The lower horizontal section 24 of upper crosswise extending stiffening member 20 is straight. The inside surface of upper crosswise extending stiffening member 20 may be padded for comfort. Vertical back straps 26 with quick releasing connecting means 12 at the free ends are securely attached at shoulder width to upper horizontal section 22 of upper crosswise extending stiffening member 20. Lateral upper body straps 28 with quick releasing connecting means 12 at the free ends are securely attached to the right and left side sections 25 of upper crosswise extending stiffening member 20.

The lower crosswise extending stiffening member 32 has a proportionally smaller rectangular shape than upper crosswise extending stiffening member 20 comprising two II shaped structures attached to rod 30. Lateral waist straps 38 with quick releasing connecting means 12 at the free ends are securely attached to the right and left side sections 34 of lower crosswise extending stiffening member 32. Vertical crotch straps 40 with quick releasing connecting means 12 at the free ends are securely attached to lower section 36 of lower crosswise extending stiffening member 32.

Figure 4:
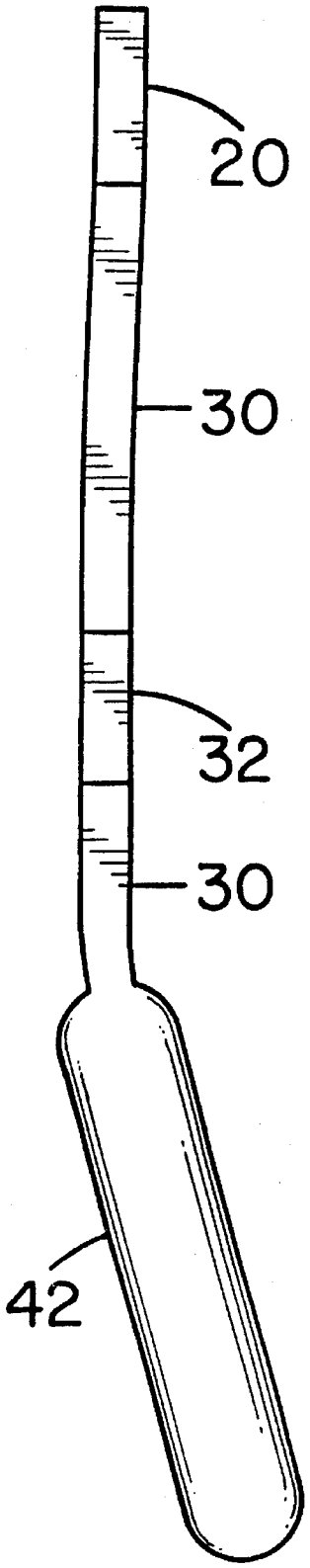
FIG. 4 is a side view of the upper and lower crosswise extending stiffening members, the rod and the attached float.

FIG. 4 is a side view of upper and lower crosswise stiffening members 20 and 32, rod 30 and float 42 showing float 42 disposed angularly to the longitudinal axis of rod 30 whereby float 42 does not interfere with the leg motion of a swimmer. Float 42 comprises a hollow cylinder rounded at the ends. Float 42 may be filled with a buoyant gas or with a low density buoyant solid filler.

In using the swimming aid back straps 10 and 26 are connected by quick releasing connecting means 12 thereby connecting vest 2 to upper crosswise extending stiffening member 20. The wearer places the head through aperture 8 and connects lateral upper body straps 14 and 28 by quick releasing connecting means 12 securing the swimming aid to the upper body. Lateral waist straps 16 and 38 are connected by quick releasing connecting means 12 securing the swimming aid to the mid section of the body. Upper crosswise extending stiffening member 20 rest against the back just below the shoulders and lower crosswise extending stiffening member 32 rests on the lower back. Vertical crotch straps 40 are passed between the legs under the crotch and connected to vertical crotch straps 18 by quick releasing connecting means 12 firmly securing the swimming aid to the body of the wearer. The swimmer may now enter the water and swim safely with the knowledge he will not sink or be in danger of drowning.

In another embodiment front section 4 of vest 2 is divided longitudinally down the center from the font edge of the orifice 8 to the lower edge of front section 4. The edges formed by said division are releasably connectable, for example by a zipper as shown at 44 in FIG. 2.

Figure 5:
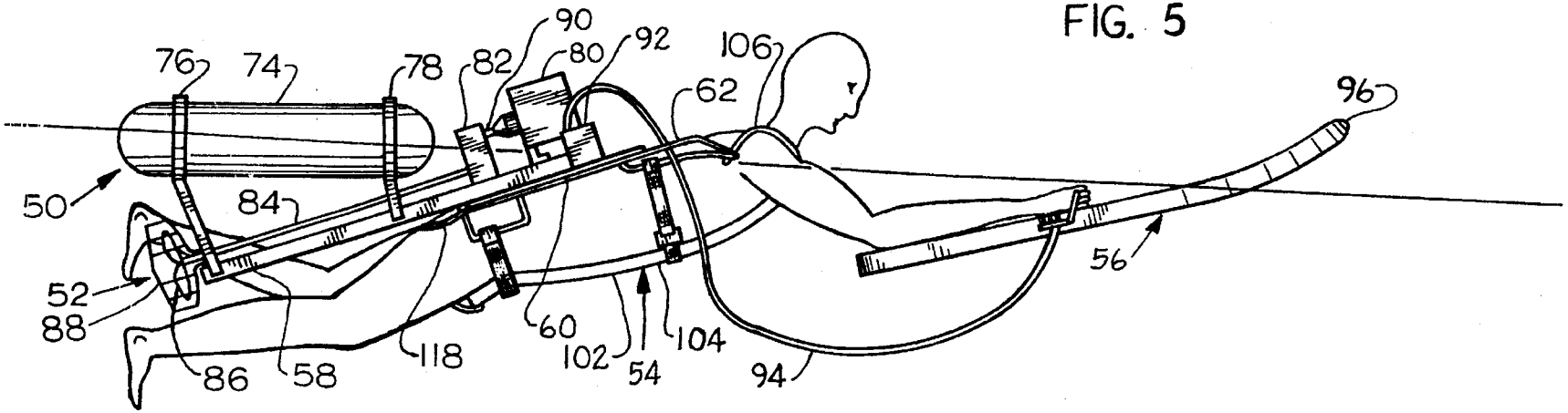
FIG. 5 is a side view of a powered embodiment of the swimming aid showing it as worn by a user.
Figure 6:
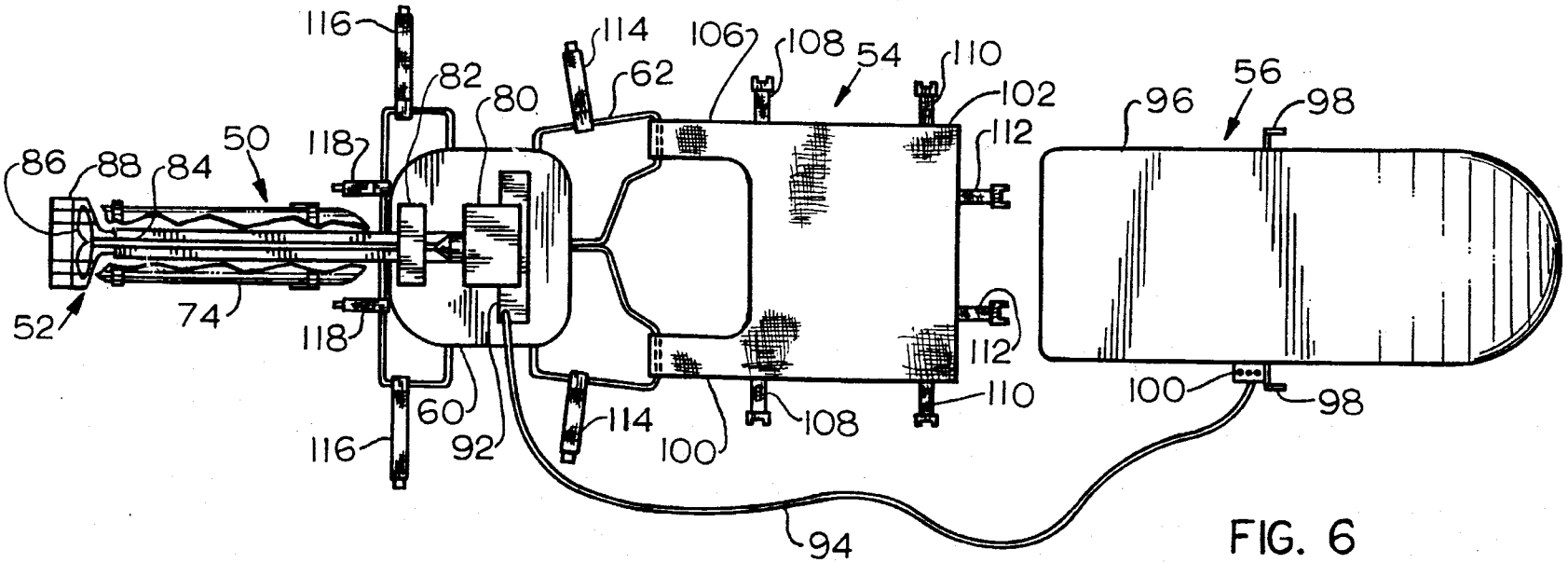
FIG. 6 is a top view of the powered embodiment of the swimming aid.
Figure 7:
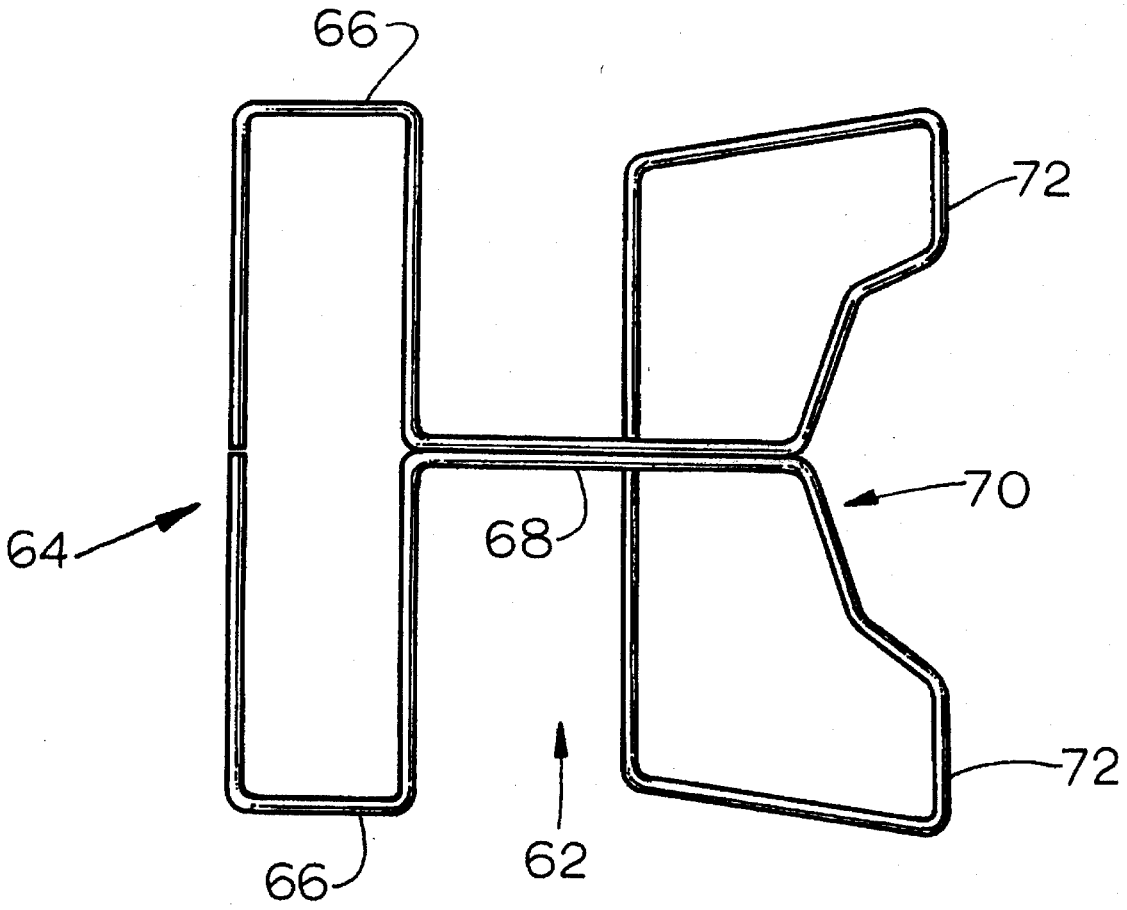
FIG. 7 is a view of the back frame.

A further embodiment of the invention is shown in FIGS. 5, 6 and 7. This embodiment incorporates a lower torso buoyancy assembly 50, a power assembly 52, a vest assembly 54 and a float and control assembly 56.

The lower torso buoyancy assembly 50 and the vest assembly 54 are generally similar in structure and purpose to that previously described, but the specific structure differs and adaptation is made to accommodate the power assembly.

The lower torso buoyancy assembly 50 has a rigid beam 58 which is attached to the top of a platform 60. Attached to the underside of the platform 60 is a back frame 62. The back frame 62 is shown in greater detail in Figure 7. It is formed by bending a rigid wire or rod into the desired shape to form a rigid frame. The ends can be welded or brayed where the terminate in contact with another portion. That shape provides a lower stabilizing portion 64, which is a pair of lower lobes 66 which extend laterally to fit at the user's lower torso. There is a central spine portion 68 which extends upwardly and an upper stabilizing portion 70 comprising upper lobes 72 which extend laterally to fit at the user's upper torso. The upper stabilizing portion 70 and the lower stabilizing portion 64 are curved to comfortably fit the user's body and are preferably covered with plastic tubing or foam for comfort.

The back frame 62, platform 60 and beam 58 are so assembled as to form a rigid structure, which when worn by the user has the beam 58 extending downwardly toward the user's feet. A buoyancy device 74 is mounted on the beam 58. The buoyancy device 74 is preferably a sealed elongated tank and is fitted on the beam 58 by mounting assemblies 76 and 78, and is oriented with respect to the beam 58 so that it extends downwardly and at an angel away from the beam 58, and therefore at an angle away from the user's body. Preferably the buoyancy device 74 is not so long as to prohibit the user from walking when on the shore. By this configuration, as seen in FIG. 5, when in use the tank will float relatively horizontally, while the beam 58 will extend into the water downward at a rearwardly extending angle. Thus, the lower portion of the user's body is lifted into a better swimming position. In addition in this powered embodiment the buoyancy device 74 has sufficient buoyancy to overcome the weight of the power assembly 52, and also to resist the downward force caused by the rotating propeller on the lower body. This latter effect is seen as similar to the effect on a motor boat, which is forced downward at its rear end when power is applied to the propeller.

The power assembly 52 comprises a motor 80, a speed reducer 82, a shaft 84, a propeller 86 and a guard 88. The motor 80 is mounted on the platform 60 over the beam 58. Any convenient fastener assembly may be used to accomplish this mounting. The shaft 84 extends from the speed reducer 82 parallel to the beam 58, having attached at its terminal end, the propeller 86. The shaft is maintained in place by bearings (not shown) incorporated into the mounting assemblies 76 and 78. Also the drive attachment 90 between the motor 80 and the speed reducer 82 as well as the shaft 84 will preferably have some type of flexible joints to accommodate misalignment. The guard 88 is an assembly of open wirework attached to the mounting assembly 76.

The motor 80 also has a control assembly 92 which incorporates a control cable 94.

The float and control assembly 56 comprises a curved plastic buoyant float 96, hand grips 98 and a control module 100. The control cable 94 is operably attached to the control terminal 100 to communicate speed control and shut-off commands for the motor 80, the control module 100 having means to vary those functions through the cable to the motor 80. The control cable 94 is a mechanical means, but electrical or even radio communications could be used. An additional control could operate a clutch to disconnect the motor 80 from the shaft 84.

The vest assembly 54 has a floatation vest 102 which has a body portion 104 and shoulder straps 106 which are attached to portions of the upper lobes 72. Therefore, when worn the shoulder straps extend over the shoulders from the upper back to the chest of the user, the body portion 104 of the vest 102 covering the front of the user's torso.

Upper vest side straps 108 and lower vest side straps 110 extend laterally from the sides of the vest 102. Crotch vest straps 112 extend from the bottom of the vest 102. These straps have connected devices at their ends.

On each of the upper loops 72 there is attached an upper frame side strap 114, and on each of the lower loops 66 there is attached a lower frame side strap 116. These straps have connection devices at their ends for fastening them respectively to the upper vest side straps 108 and lower vest side straps 110.

Similarly, crotch frame straps 118 are attached to the lower loops 66 and have connecting devices to fasten between the user's legs to the crotch vest straps 112.

An exemplary motor 80 is a Homelite ST 175. An exemplary speed reducer operates at a 1:4 ratio. Other types of motors could be used. For example, an electric motor powered by a rechargeable battery could be used. The speed reducer may not be necessary if the motor speed is suitable for the intended use. As noted above a clutch could be incorporated into the power train.

In use the embodiment above described and shown in FIGS. 5, 6, and 7 functions as previously described. In particular vest 54 will in general urge the torso toward an upright floating position. The buoyancy device 74 acting through the beam 58 and the stabilizing frame 70 will rotate the body into a good swimming position by lifting the lower torso, the vest still keeping the upper portion of the torso above or at the surface.

Addition of the power assembly 52 will enable the user to traverse long distances. Also, due to the downward, rearward angle of the propeller, the user's head is urged out of the water.

The float 56 is used by the user to change directions and provides a resting place for the arms. But adjusting the front 56 position a comfortable fast movement can be accomplished.

Therefore, this embodiment has all the advantages of the previously described embodiment of FIGS. 1–4, but in addition the advantages provided by the power assembly 52 and the float and control assembly 56. Also, the upper and lower stabilizing portions 70 and 64 respectively being incorporated into a wire or rod framework 70 provide greater comfort and light weight.

The invention being thus described it will be obvious that the same may be varied in many ways. Such variations are not to be regarded as a departure from the spirit and scope of the invention, and all such modifications as would be obvious to one skilled in the art are intended to be included within the scope of the following claims.

I claim:

1. A powered swimming aid to be worn on the body of a person comprising:

a lower torso buoyancy assembly attachable to the back of a person's torso having a lower stabilizing member for placement proximate a person's lower torso and being a rigid member extending substantially across the body of the user and an upper stabilizing member rigidly attached to the lower stabilizing member and located spaced above the lower stabilizing member for placement proximate the user's shoulders and a buoyancy device being a rigid elongate buoyancy member rigidly attached to the lower stabilizing member to form therewith a single rigid structure, the buoyancy device being located below the lower abilizing member and means for attaching the lower stabilizing member and the upper stabilizing member to the person's torso;

and a drive assembly mounted on the lower torso buoyancy assembly comprising a rotational power train terminating in a propeller which propeller is located below the knees of the user; and the drive assembly being incorporated as a part of the aforesaid single rigid structure and the buoyancy member being displaced from the propeller away from a user's body.

2. The powered swimming aid of claim 1 wherein the rotational power train comprises a motor mounted on the lower torso buoyancy assembly adjacent the back of the user, a speed reducer operably connected to the motor and located below the motor, a drive shaft extending downwardly from the speed reducer and the propeller being mounted on the drive shaft.

3. The powered swimming aid of claim 1 further comprising a floatation vest attached to the lower torso buoyancy assembly and spaced therefrom to enable the floatation vest to be placed on the front of the user's torso.

4. The powered swimming aid of claim 1 wherein the lower stabilizing member and the upper stabilizing member are formed of rigid rod material bent into the defined shape thereof.

5. The powered swimming aid of claim 1 said drive assembly further comprising a mounting plate mounted on said buoyancy assembly proximate the lower torso of the user and a motor being mounted on the mounting plate, and an elongated bar attached to and extending downwardly from the mounting plate.

6. The powered swimming aid of claim 5 wherein the buoyancy device is attached to the elongated bar and extending downwardly and being angled away from the person's body along its elongate dimension.

7. The powdered swimming aid of claim 5 wherein the drive assembly further comprises a shaft driven by the motor at one end and having the propeller attached to it at the other end.

8. The powdered swimming aid of claim 1 wherein the shaft is rotatably supported on the elongated bar.

9. The powered swimming aid of claim 1 further comprising a float to provide buoyancy to the user's hands and arms and direction control.

10. The powered swimming aid of claim 9 further comprising a control module on said float having controls at least for controlling speed and shut off of the drive assembly and control communication means for transmitting control commands from the control module to the drive assembly.

11. The powered swimming aid of claim 9 wherein said float has hand gripping means on each side for the user's hands.

12. The powered swimming aid of claim 11 wherein the float has a rear portion on which the user's arms can rest, and an upwardly curved front portion.

13. The powered swimming aid of claim 1 wherein;

the buoyancy device having its long dimension extending downwardly of a person's body below the lower stabilizing member and being angled away from the person's body along its elongate dimension and means for attaching the lower stabilizing member to the lower portion of a person's torso whereby buoyancy of the buoyancy device will act on the lower stabilizing member and the upper stabilizing member to orient the torso into a comfortable position.

14. The powered swimming aid of claim 13 further comprising a floatation vest attached to the lower torso buoyancy assembly and spaced therefrom to enable the floatation vest to be placed on the front of the user's torso.

15. The powered swimming aid of claim 1 wherein:

the drive assembly is mounted on top of and between the lower stabilizing member and the upper stabilizing member.

16. The powered swimming aid of claim 1 wherein the propeller and buoyancy device extend less than the length of the user's legs.

* * * * *